United States Patent [19]

Litwiller

[11] Patent Number: 4,483,506

[45] Date of Patent: Nov. 20, 1984

[54] TEMPORARY SIGNPOST SUPPORT SLEEVE AND TOOL FOR UNSETTING SAME

[75] Inventor: Donald D. Litwiller, Eureka, Ill.

[73] Assignee: Compass Enterprises, Inc., Peoria, Ill.

[21] Appl. No.: 263,878

[22] Filed: May 15, 1981

[51] Int. Cl.[3] ..... F16M 13/00

[52] U.S. Cl. ..... 248/545; 248/156

[58] Field of Search ..... 248/545, 156, 469, 121, 248/530, 533; 40/606, 607; 52/156, 165, 298

[56] References Cited

U.S. PATENT DOCUMENTS

| | | | |
|---|---|---|---|
| 1,570,192 | 1/1926 | Younick | 254/131 |
| 3,809,346 | 5/1974 | Jackson | 248/530 |
| 3,873,068 | 3/1975 | Allen | 254/131 |
| 3,985,338 | 10/1976 | Herrmann | 254/131 |
| 3,990,592 | 11/1976 | Migliano | 254/134 X |
| 4,120,125 | 10/1978 | Cvetan | 52/165 X |
| 4,235,034 | 11/1980 | Black | 248/545 X |
| 4,326,352 | 4/1982 | Barth | 40/607 |
| 4,327,514 | 5/1982 | Bourque | 40/607 |
| 4,378,650 | 4/1983 | Ottoson | 40/607 |

*Primary Examiner*—J. Franklin Foss

*Attorney, Agent, or Firm*—McCaleb, Lucas & Brugman

[57] ABSTRACT

A signpost support sleeve comprises an upwardly open upright socket member having a horizontal footplate across the bottom, and a vertical spike on the underside of the footplate. A special unsetting tool is driven beneath the plate to apply a removing force directly to the sleeve. In the embodiment shown, the socket member has a square recess for a square post having a forwardly extending, cantilever cross arm to which an appropriate sign is fastened. The footplate is generally rectangular. It extends cantileverly forwardly and bears foot-like against the ground to keep the post from leaning forwardly under the weight of the cross arm and sign. The unsetting tool comprises an L-shaped lever having a tooth at one end engageable with one of three underside openings along the rear edge of the footplate. The openings on the underside of the footplate serve the dual function of providing drain openings for the socket member recess and providing a choice of seats for the tooth at the end of the unsetting tool. A hammer lug is fastened across the tool behind the tooth. The lug can be hammered to drive the tool beneath the footplate to align the tooth with one of the openings. The sleeve is then lifted out of the ground by prying the tool about the hammer lug acting as a fulcrum against the ground.

4 Claims, 7 Drawing Figures

TEMPORARY SIGNPOST SUPPORT SLEEVE AND TOOL FOR UNSETTING SAME

BACKGROUND OF THE INVENTION

This invention relates to a signpost support sleeve of the kind used for temporarily supporting a signpost, as for example, on the lawn of property being offered for sale.

Because such a signpost is removed after the property is sold, it should be capable of being set and unset easily without damaging the lawn, and it should be large and substantial to readily attract prospective buyers and resist damage or dislocation by vandals.

Typically, such a sleeve comprises an upwardly open upright socket member within which the signpost is held. A downwardly extending spike holds it in the ground deeply enough that a substantial effort is required to unset it.

One such signpost support sleeve and unsetting device are shown in U.S. Pat. No. 4,120,125. The unsetting device there is illustrated as a jack having a long, vertical lifting bar which engages both the socket member and the post enabling the jack to pull the spike out of the ground. This unsetting device is unnecessarily costly and bulky. This situation is accordingly in need of improvement to make the unsetting device less costly and more compact and effective.

SUMMARY OF THE INVENTION

Therefore, a principle object of the present invention is to provide such a signpost support sleeve which is readily removable from the ground by a simple and compact unsetting tool.

More particularly, it is an object of this invention to provide such a signpost support sleeve with a forwardly extending cantilever footplate having at least one underside opening along the rear edge and, further, to provide a lever-like unsetting tool having a hammer lug effective when hammered to drive a tooth-bearing end of the tool beneath the footplate to lock the tooth in the footplate opening and enable the tool to be pried about the hammer lug acting as a fulcrum against the ground, thereby unsetting the sleeve.

Another object of this invention is to locate the footplate opening in communication with the bottom of the socket member recess to serve the dual purpose of providing a drain for the recess in addition to an interlocking seat for the tool during the unsetting operation; this also helps keep the sleeve from rusting because of moisture and helps keep the post from rotting and swelling in the sleeve for easy removal.

Another object is to provide an opening or openings along the rear edge of the footplate in one or more readily accessible and known locations such as the corners, or the center, of the rear edge of the footplate so one can readily be located for the unsetting operation even when obscured because the footplate is pressed against the ground.

BRIEF DESCRIPTION OF THE DRAWINGS

Other objects and advantages will be apparent from the following description taken in connection with the accompanying drawings in which.

Like parts are referred to by like reference characters throughout the drawings.

DESCRIPTION OF THE PREFERRED EMBODIMENT

Figure 1:
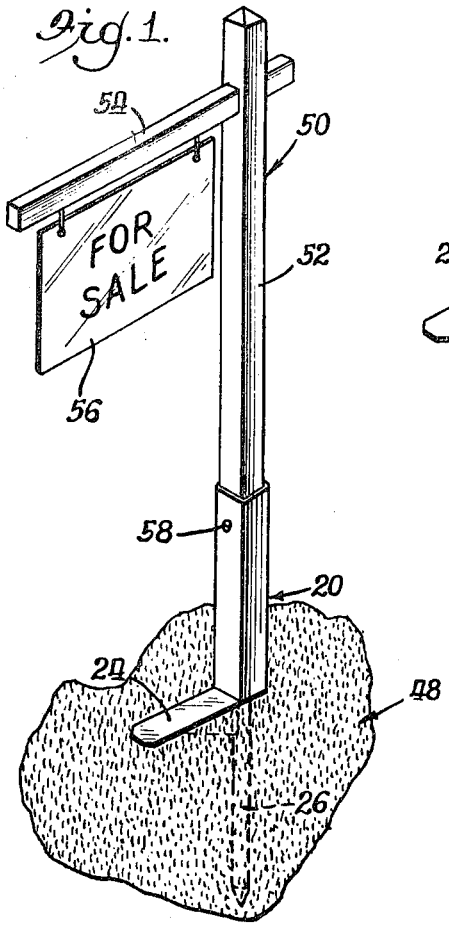
FIG. 1 is a perspective view of a preferred form of signpost support sleeve illustrating it supporting a real estate For Sale sign.
Figure 2:
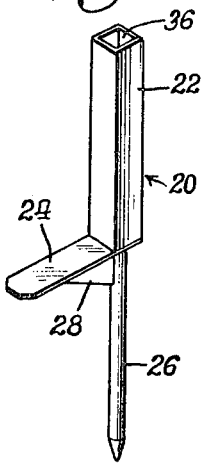
FIG. 2 is an enlarged perspective view of the sleeve shown in FIG. 1.

Referring now to the specific embodiment of the invention shown in the drawings, the improved signpost sleeve is generally designated 20. It comprises a vertically elongated, upwardly open socket member 22, a stabilizing footplate 24, and a vertical spike 26 on the underside of the footplate rigidified by a gusset 28. The parts are made of metal such as steel and fabricated into one integral assembly as by welding. Alternatively, some or all of the components may be castings.

Figure 7:
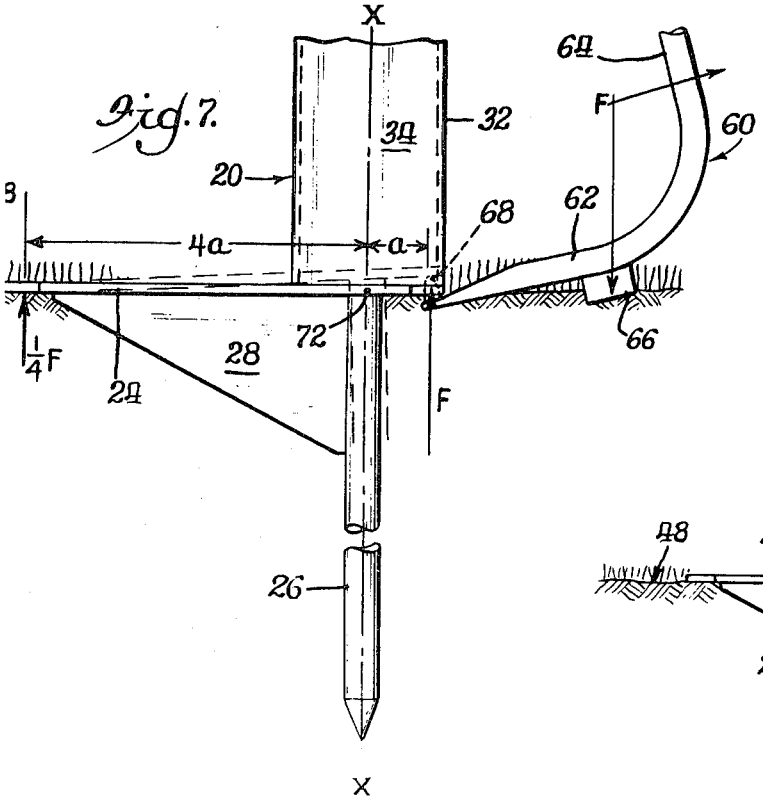
FIG. 7 is an enlarged, fragmentary view of FIG. 6 showing in somewhat schematic form the direct and reaction forces applied to the sleeve as the tool begins to exert upward force on it.

The socket member as illustrated here is a square tube with a front wall 30, back wall 32, and side walls 34, 34 enclosing an upwardly-open, square cross-section recess 36 extending along a vertical axis X—X (FIG. 7).

Figure 3:
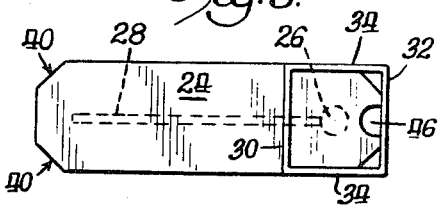
FIG. 3 is a top plan view of FIG. 2.
Figure 4:
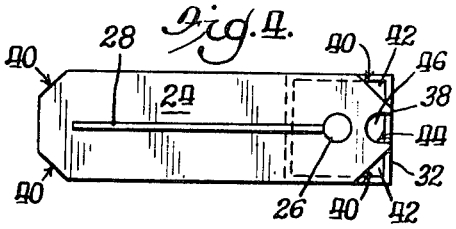
FIG. 4 is a bottom plan view of FIG. 2.

The stabilizing footplate 24 is generally rectangular and is fastened across the bottom end of the socket member 22, extending cantileverly forwardly therefrom to stabilize the sleeve against forward tilting dislocation under the weight of a forwardly cantileverly supported sign as will be described. As best shown in FIG. 4, the footplate rear edge 38 is mounted flush with the socket member back wall 32. As best shown in FIGS. 3 and 4, all four corners are cut off along diagonal edges 40. At the rear of the footplate, this provides two corner openings 42, 42 which are vertically aligned with the rear corners of the socket recess 36. At the front of the footplate, these diagonal edges eliminate sharp and otherwise possibly hazardous corners which could snag clothing and injure a person handling the sleeve.

A center slot 44 is also provided in the rear edge of the footplate. This provides a center opening 46 which is vertically aligned with the rear portion of the socket member recess 36 just inside the back wall 32.

In use, the sleeve 20 will be set in the ground by a conventional hammer or pounding device (not shown) which may be roughly the same shape as the socket recess 36. It will be hammered against the footplate 24 in the bottom of the socket until the spike 26 is driven completely into the ground and the footplate is flat against the ground surface.

When the sleeve is thus set in the ground, a signpost of any suitable kind may be dropped into the socket member recess 36. The signpost 50 shown here comprises a vertical post 52 having approximately the same cross-section as the recess. It has a forwardly extending cantilever cross arm 54 holding a sign 56. If desired, the post 52 may be fastened in the sleeve by means of a wood screw or bolt 58.

The cantilever cross arm 54 moves the center of gravity of the assembly substantially forwardly of the sleeve center line. To support it, the footplate 24 is likewise extended cantileverly forwardly. This stabilizes the sleeve against forward tilting dislocation under the weight of the cross arm and sign.

Figure 5:
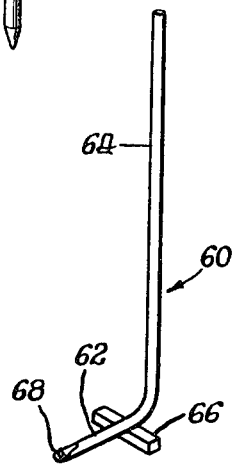
FIG. 5 is a perspective view of the special unsetting tool.

A special unsetting tool 60 is shown in FIG. 5. It cooperates with a selected one of the openings 42, 42 and 46 at the rear edge of the footplate to unset the sleeve. This will now be described.

The tool 60 is in the form of an L-shaped lever with a short, horizontal arm 62 and a relatively longer vertical arm 64. A hammer lug 66 consisting of a transverse bar is fastened as by welding to the underside of an intermediate section of the tool, between the two arms 62 and 64. An upstanding tooth 68 is provided on the forward end of the short arm.

Figure 6:
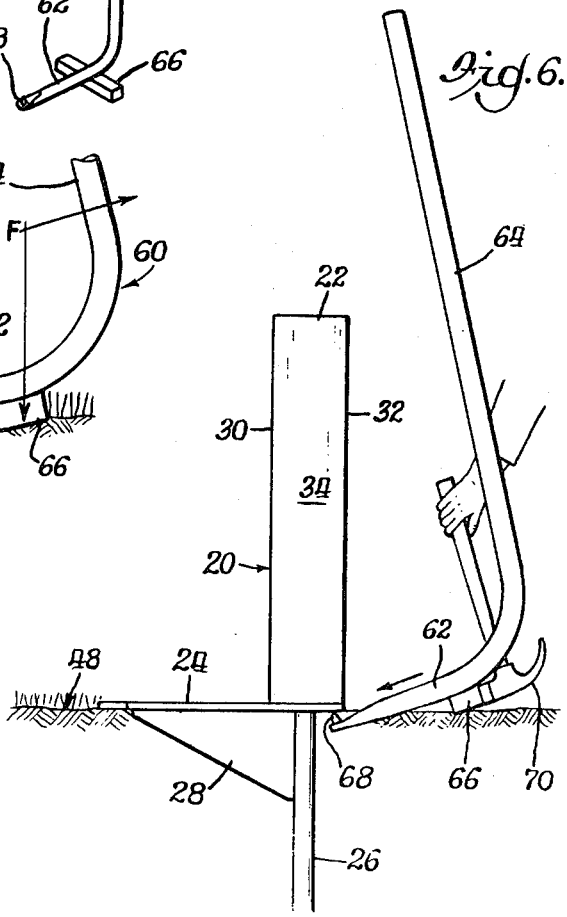
FIG. 6 is a side view of the sleeve set in the ground, showing the use of the special tool at the beginning of the unsetting operation.

To remove the sign assembly shown in FIG. 1, the first step preferably will be to lift the post, cross arm, and sign out of the sleeve, leaving it empty as shown in FIG. 6.

At this stage, it will be understood that the bottom surface of the footplate is completely hidden against the ground. View is often further obscured by grass when the sign is placed on a lawn. It is important that the location of the openings in the plate be known so the tool can be inserted with the tooth 68 aligned with a selected one of the openings. Only the corner openings 42, 42 may be provided; only the center opening 46 may be provided; or all three may be provided as shown. Whatever the choice of openings, this will be known to the person using the unsetting tool so he can drive it into position to set within a selected opening.

The final step in using the tool is shown in FIG. 6. A hammer 70 will be used against the hammer lug 66 to d rive the end of the short arm 62 beneath the footplate 24 to seat the tooth 68 in a selected one of the openings 42, 42 and 46. Then, by pulling backward on the long arm 64, the tool will rotate clockwise (FIGS. 6 and 7) about the hammer lug 66 which now acts as a fulcrum against the ground.

The resulting application of forces is shown in FIG. 7. For the sake of this example, the tooth 68 is shown a distance a behind the axis X—X; and the front edge of the footplate is a distance 4*a* forwardly of that axis.

Considering the moments of the forces and reactions about a point 72 (where axis X—X intersects the footplate), at the instant the tooth enters one of the openings in the plate and starts to lift it, a force F is applied downwardly to the ground through the fulcrum 66. This will cause a similar force F to be applied upwardly to the back edge of the footplate by the forward end of the short arm 62. This will be accompanied by an upward reaction from the ground, of a value one-fourth F at the front edge of the plate. Thus, the relatively long forward overhang of the footplate 24 will limit the forward tilting angle of the sleeve when the tool 60 applies the effort needed to free the spike from the ground. Because of this, only a relatively short upward displacement will be needed to release the spike from most soils sufficiently that it can then easily be removed from the ground manually. This will occur at some minimally-displaced position as is shown in broken lines in FIG. 7.

Thus, the interaction between the tooth 68 and a selected one of the openings in the rear edge of the footplate keeps the tool from slipping out of engagement with the sleeve, and holds them inter-engaged in a relationship where the best mechanical advantage is obtained as the spike is being loosened.

Each of the openings 42, 42 and 46 serves the dual purpose of interlocking the tooth 68 during unsetting as described, plus draining any water that would otherwise collect in the socket member recess.

The above described arrangments and methods illustrate a small number of many possible specific embodiments of this invention. Numerous and varied other arrangements and methods can readily be devised, in accordance with the principles disclosed, by those skilled in the art without departing from the spirit and scope of the invention.

The embodiments of the invention in which an exclusive property or privilege is claimed are defined as follows:

1. The combination of a post support sleeve temporarily settable in the ground having a vertically elongated, upwardly open socket number with an upwardly open recess extending along a vertical axis adapted to receive the lower end portion of a post which has a forwardly extending cantilever crossbar, a stabilizing footplate fastened across the bottom end of said socket member and extending cantileverly forwardly therefrom to stabilize the sleeve against forward tilting dislocation under the forward overhanging weight of the crossbar, and a spike fastened to the underside of said horizontal footplate and extending downwardly along the vertical axis of said socket member, and unsetting means for removing the sleeve after the spike has been driven into the ground up to the footplate, comprising:

(a) a first interlocking means on the underside of the footplate at the rear end thereof;

(b) a generally L-shaped lever with a relatively long vertical arm and a relatively short horizontal arm interconnected at a bend;

(c) a hammer lug relatively wider than the lever fastened outwardly across the backside of the lever at the bend in position for engagement by a hammer to drive the forward end of the short arm into the ground beneath the rear end of said footplate; and (d) a second interlocking means on the upper side of the forward end of said short arm being dimensioned and proportional to engage said first interlocking means on the underside of the footplate when driven into the ground by hammer blows on said hammer lug;

whereby, after the spike has been driven into the ground to set the sleeve, it can be unset by blows applied to the hammer lug to drive the forward end of the short arm into the ground beneath the sleeve to engage said first and second interlocking means followed by pulling the long arm to rotate the lever about the hammer lug acting as a fulcrum against the ground while the forward end of the footplate acts as a fulcrum for the footplate against the ground to hold the socket member substantially erect during initial loosening of the spike.

2. The combination of claim 1 in which said first interlocking means comprises aperture means in the footplate and said second interlocking means comprises upstanding tooth means on the end of said short arm engageable with said aperture means and adapted to be forced between the footplate and the ground and pried upwardly against the footplate.

3. The combination of claim 2 in which the socket member has a square recess with a pair of rear corners spaced apart along the rear edge of the footplate and said aperture means comprises angularly cut off corners at opposite sides of the rear edge of the footplate to provide a pair of openings vertically aligned with rear corners of the socket member recess inside the socket member rear corners, said pair of openings being engageable with said upstanding tooth means.

4. The combination of claim 2 in which the aperture means comprises an opening in the center of the rear edge of the footplate vertically aligned with the rear portion of the socket member recess inside the socket member rear wall, said opening being engageable with said upstanding tooth means.

* * * * *

UNITED STATES PATENT AND TRADEMARK OFFICE

CERTIFICATE OF CORRECTION

PATENT NO. : 4,483,506

DATED : November 20, 1984

INVENTOR(S) : Donald D. Litwiller

It is certified that error appears in the above-identified patent and that said Letters Patent is hereby corrected as shown below:

Claim 1, line 3, "number" should be --member--; and line 28, "proportional" should be --proportioned--.

Signed and Sealed this

Ninth Day of April 1985

[SEAL]

*Attest:*

DONALD J. QUIGG

*Attesting Officer*

*Acting Commissioner of Patents and Trademarks*